US005195659A

United States Patent [19]

Eiskant

[11] Patent Number: 5,195,659

[45] Date of Patent: Mar. 23, 1993

[54] DISCREET AMOUNT TOOTHPASTE DISPENSER

[76] Inventor: Ronald E. Eiskant, 305 N. 9th St., Belleville, Ill. 62220

[21] Appl. No.: 787,549

[22] Filed: Nov. 4, 1991

[51] Int. Cl.[5] ..... B65D 35/28

[52] U.S. Cl. ..... 222/102; 222/105

[58] Field of Search ..... 222/101, 102, 105, 181, 222/336, 391

[56] References Cited

U.S. PATENT DOCUMENTS

| | | | |
|---|---|---|---|
| 2,530,327 | 11/1950 | Derrick | 222/102 |
| 2,550,537 | 4/1951 | Derrick | 222/102 |
| 2,837,243 | 6/1958 | Zebnik | 222/101 |
| 3,257,039 | 6/1966 | Trutza | 222/102 |
| 3,738,533 | 6/1973 | Bertrand | 222/102 |
| 3,860,147 | 1/1975 | Vesslo | 222/96 |
| 4,226,336 | 10/1980 | Young | 222/102 |
| 4,234,104 | 11/1980 | Apuzzo, Jr. et al. | 222/94 |
| 4,629,095 | 12/1986 | Smith | 222/96 |
| 4,651,904 | 3/1987 | Schuckman | 222/383 |

FOREIGN PATENT DOCUMENTS

| | | | |
|---|---|---|---|
| 1602298 | 11/1981 | United Kingdom | 222/102 |

*Primary Examiner*—Gregory L. Huson
*Attorney, Agent, or Firm*—Don W. Weber

[57] ABSTRACT

An automatic toothpaste dispenser is disclosed which forces a discreet amount of toothpaste from a tube by moving a plunger in a downward direction. The toothpaste dispenser has two halves which are hinged at the top to allow the tube of toothpaste to be inserted in the device. The front of the device has a plunger which activates two rear rollers inside the device which move downwardly to squeeze toothpaste out of the tube. The front plunger is attached to a front inner mechanism having engaging teeth. The inner mechanism slides on pins which are inserted into grooves. The grooves allow the inner drive mechanism to move down until the lower pins of the drive mechanism engage a guide which pushes the drive mechanism forward to engage corresponding teeth on the rear housing containing the rollers. A spring always brings the front inner drive mechanism back towards the top of the case. The front inner drive mechanism disengages from the rear rollers on its upward path due to the unique system of grooves of the front piece. Each successive motion of the plunger downward will provide a discreet amount of toothpaste to the user.

1 Claim, 3 Drawing Sheets

DISCREET AMOUNT TOOTHPASTE DISPENSER

BACKGROUND OF THE INVENTION

This invention relates to the field of dispensers and more particularly to a simple toothpaste dispenser which releases discreet amounts of toothpaste upon movement of a front lever.

Many different types of dispensers have been known in the dispensing art. In particular, a number of toothpaste dispensers have been patented and manufactured which dispense toothpaste from a flexible tube in various ways.

The most common type of dispenser involves parallel worm gear elements which drive rollers down opposite sides of a toothpaste tube. These rollers in turn discharge the toothpaste from the end of the tube. Some of these devices, particularly as shown and described in the Zebnik dispenser, U.S. Pat. No. 2,837,243, are quite complicated with multiple moving parts, pivots and gears. Motorized versions, such as the one disclosed in the 1973 patent to Bertrand, U.S. Pat. No. 3,738,533, are also in existence.

Certain types of devices utilizing crank levers, clutch systems, and various gearing mechanisms are also shown and described in the prior art.

However, all of the known devices utilize either motorized or highly complex gearing mechanisms. The major drawback encountered when using these types of mechanisms with the dispensing of toothpastes is that the mechanisms tend to become clogged or otherwise inoperative. Additionally, dispensing toothpaste in a discreet amount by using a simple lever mechanism would greatly add to the ease of use of such a device and hence to its attractiveness to today's market.

It is an object of this invention to provide a simple toothpaste dispenser which dispenses toothpaste by the single action of pushing a lever. It is a further object of this invention to supply such a toothpaste dispenser which has very few operating parts and which may be kept clean and trouble-free for years.

It is a still further object of this invention to supply a toothpaste dispenser which dispenses toothpaste in a discreet amount for the consumer. It is a still further object of this invention to provide a toothpaste dispenser which is readily adaptable to different sizes of toothpaste tubes. Other and further objects of this invention will become obvious upon reading the following Specification and Drawings.

DETAILED DESCRIPTION OF THE PREFERRED EMBODIMENT

Figure 1:
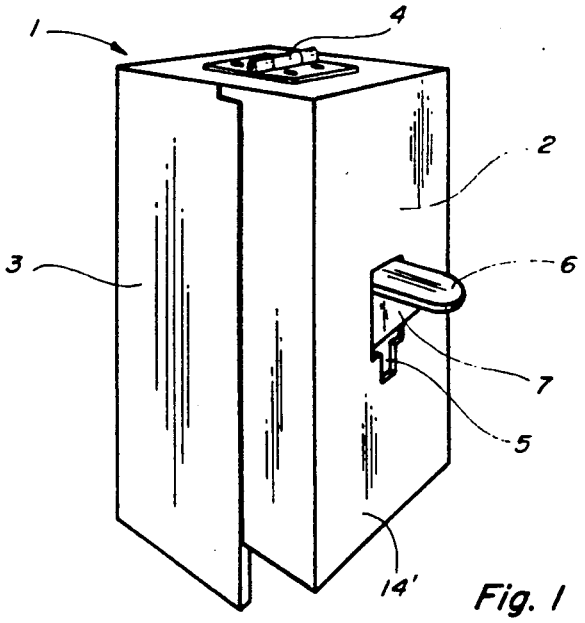
FIG. 1 is an outer perspective view of the toothpaste dispenser.
Figure 3:
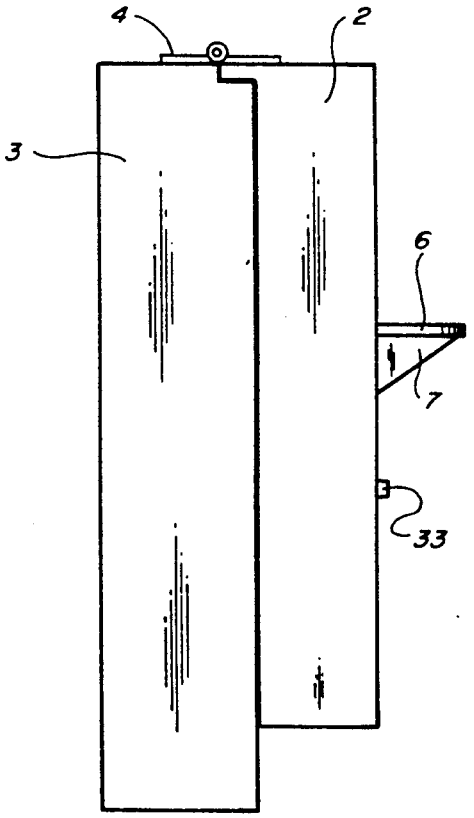
FIG. 3 is a side view of the toothpaste dispenser.
Figure 4:
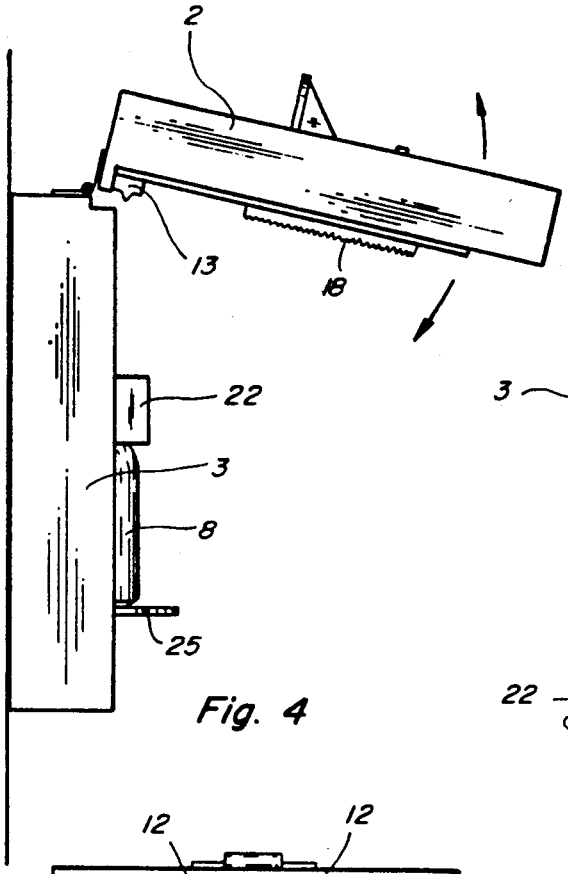
FIG. 4 is a side view of the toothpaste dispenser showing the front half of the outer casing, pivoted upwards.

The toothpaste dispenser shown and described herein is made up generally of an outer case 1 which is hinged at the top so as to form a front half 2 and a rear half 3, as best shown in FIGS. 1 and 3. The front and rear halves are hinged at the top by hinges 4 so that the front half 2 may pivot upwardly as shown in FIG. 4. In order to place the tube of toothpaste 8 into the device this front half 2 must pivot upwardly as shown.

Figure 2:
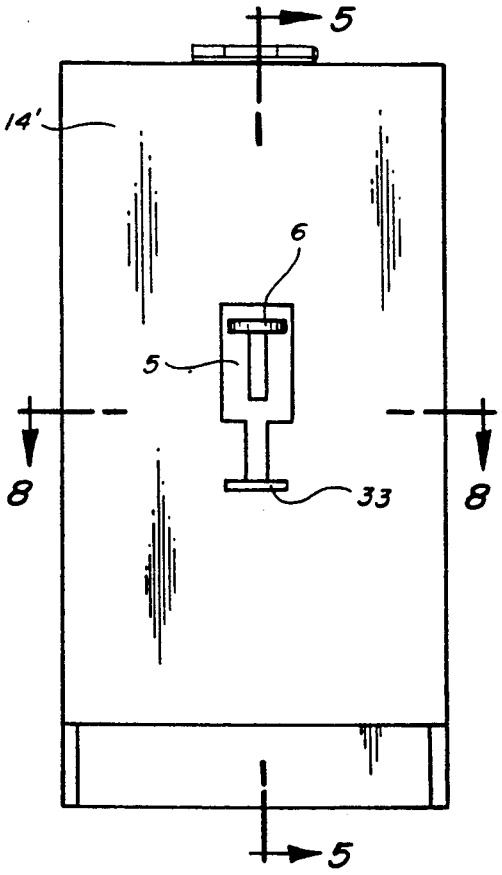
FIG. 2 is a front view of the toothpaste dispenser.

As best shown in FIG. 2, a front aperture 5 is cut into the front surface of the front half in order to accommodate the protrusion of the toothpaste plunger 6. This toothpaste plunger 6 is braced by the plunger brace 7 as shown in FIGS. 1, 2 and 3. With the front half 2 pivoted upwardly as shown in FIG. 4, the tube of toothpaste 8 may be inserted into the device.

Figure 5:
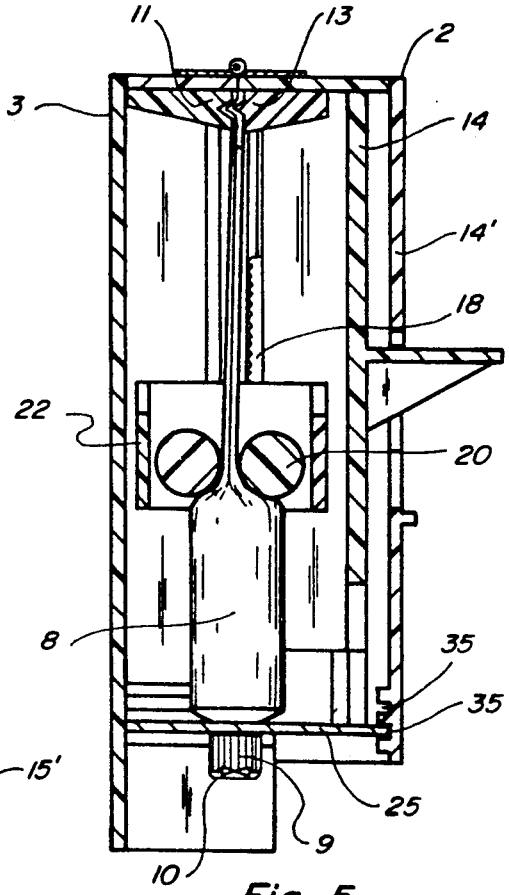
FIG. 5 is a side cutaway view of the toothpaste dispenser taken along lines 5—5 of FIG. 2.
Figure 9:
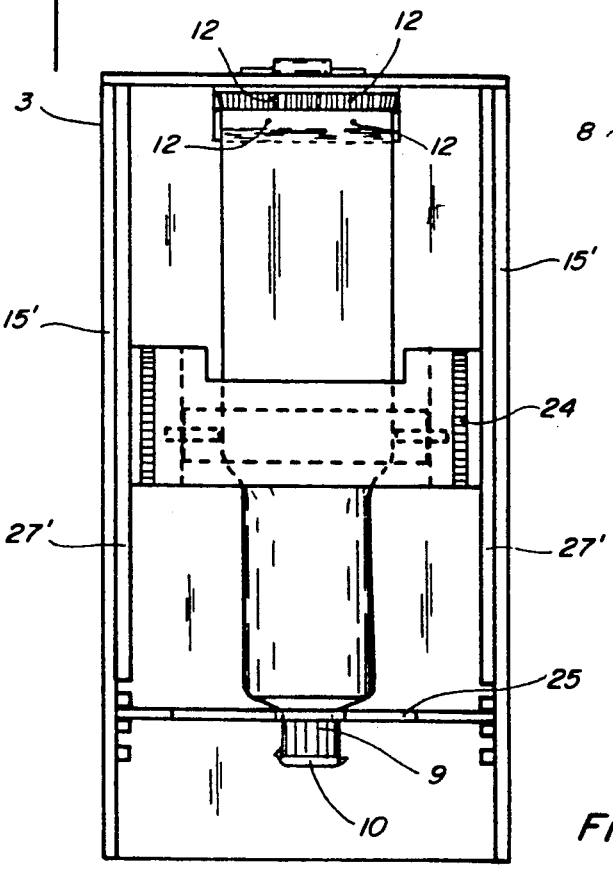
FIG. 9 is a front internal view of the rear half of the device showing the internal mechanism of the invention.

As best shown in FIGS. 4 and 5, the toothpaste is inserted with the cap end 9 downward and the other end of the toothpaste secured near the top of the dispenser. The toothpaste neck is inserted through a hole in the toothpaste tube cap bracket 25 and the toothpaste cap 9 is then refastened to the neck of the toothpaste tube, as shown in FIG. 5. The toothpaste cap 9 has a hinged lid 10 which is a standard feature on toothpaste tubes sold commercially. Near the top of the device is the top toothpaste holder which comprises a rear indented bracket 11 attached to the rear half of the outer case. Attached to the front half of the outer case is a front toothpaste holder 13 which has a triangular protrusion facing the rear toothpaste bracket 11. The rear toothpaste bracket 11 also has a certain number of gripper teeth 12 (best shown in FIG. 9) which hold that portion of the tube of toothpaste securely. When the tube of toothpaste is inserted into this upper toothpaste holder, the teeth and the vise-like gripping action of the front and rear holders, when the front section is securely closed, hold the bottom part of the toothpaste tube securely, as shown in FIGS. 5 and 9.

Figure 6:
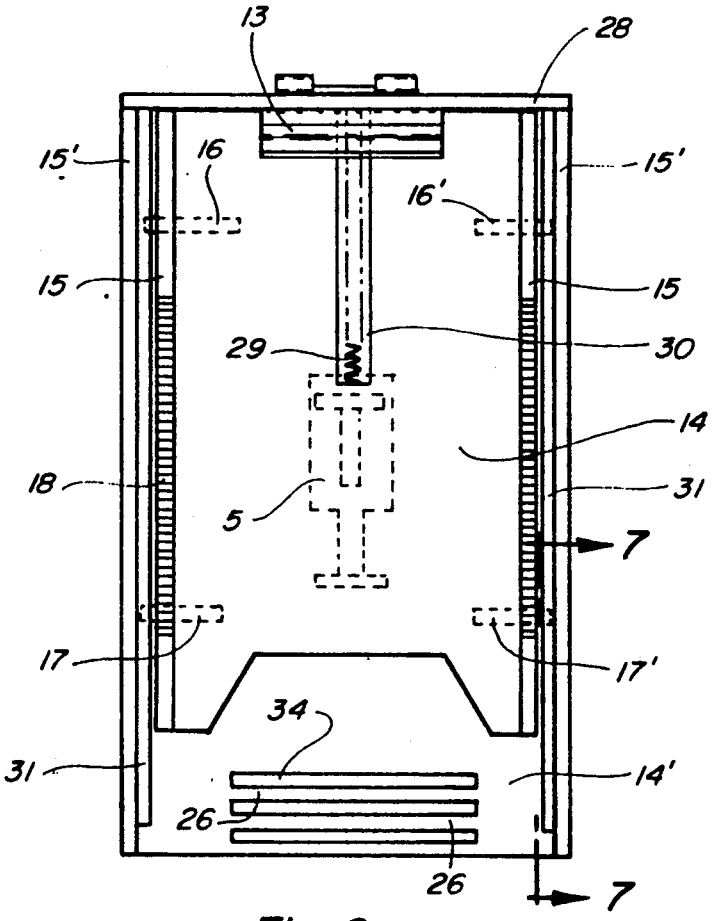
FIG. 6 is a front internal view of the front half of the toothpaste dispenser showing the internal mechanisms of the device.
Figure 8:
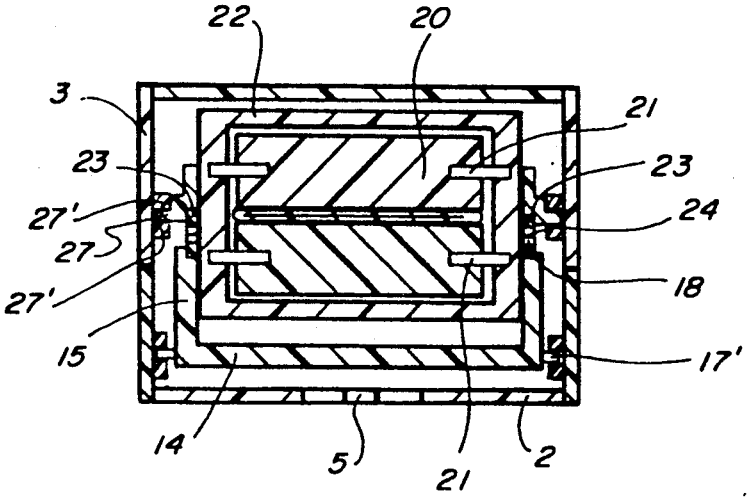
FIG. 8 is a cutaway view taken along lines 8—8 of FIG. 2 showing the internal mechanism of the device.

Turning now to the front driving mechanism, including the plunger, FIG. 6 shows the internal working mechanism of the front half 2 of the dispenser. Inside the outer side walls 15' of the dispenser is an inner front surface 14 which lies parallel to the outer front surface 14' (FIG. 5). This inner front surface 14 has inner front sides 15 (FIG. 6) which run parallel to the outer front sides 15'. The inner front surface 14 and inner front sides 15 are joined as shown in FIGS. 6 and 8. This inner front mechanism rides in longitudinal grooves (which run perpendicularly up each side 15') by means of upper front pins 16 and 16' and lower front pins 17 and 17', as best shown in FIG. 6. Along the outer edge of the inner front sides 15 are engaging teeth 18. These engaging teeth 18 correspond and come into contact with opposed roller drive engaging teeth 24.

In order to squeeze the toothpaste from the tube in discreet amounts rear parallel rollers 20 are provided. These rear rollers 20 turn freely about axles 21, as best shown in FIG. 8. The rollers and roller axles are pivotably attached to the roller housing 22 which rides inside the outer case 1 and inner sides 15 of the mechanism. The tube of toothpaste is inserted between the rollers and toothpaste is dispensed through the tube cap 9 by means of the downward pinching actions of the rollers 20.

The rear roller housing 22 is essentially rectangular and fits within the other inner mechanisms as best shown in FIG. 8. Attached to the rear roller housing are small L-shaped brackets 23 which ride inside roller housing parallel groove guides 27'. These guides form a groove 27 to receive the L-shaped brackets. The roller housing parallel groove guides 27' are attached to the sides of the rear half of the outer casing as best shown in FIG. 9. Attached to the rear roller housing L-shaped brackets 23 are a second set of roller housing bracket teeth 24, as best shown in FIGS. 8 and 9. These roller housing teeth 24 are integral with the roller housing 22 which contains the two rollers 20. The roller housing parallel guides 27' are attached to the sides of the rear half of the outer case 3. The roller housing teeth 24 and the front teeth 18 engage each other to drive the rollers downward.

The only drive mechanism used to drive this particular device is a simple spring 29. This spring 29 is attached to the top 28 of the outer front half 2 (FIG. 6) of the outer case. Cut out from the center of the inner front surface 14 of the inner front mechanism is a longitudinal slot 30. The spring 29 runs down the longitudinal slot 30 and is attached to the inner front surface 14. Also attached on the opposite side of the inner front surface 14 is the plunger 6 and plunger brace 7. The plunger 6 protrudes out the plunger aperture 5 on the front surface 14' of the front half 2 of the outer case.

Figure 7:
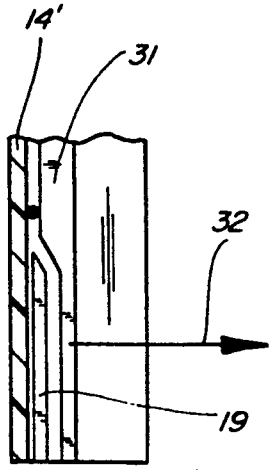
FIG. 7 is a side cutaway view of the lower portion of the front half of the toothpaste dispenser showing the lower pins and engaging guide taken along lines 7—7 of FIG. 6.

The front teeth and rear teeth are normally not engaged. This is due to the spacing of the rear roller housing guides and the front pin engaging guides 31. The front inner mechanism rides within the front guides 31 by means of the upper and lower front pins 16, 16', 17 and 17'. As shown in FIG. 7, this front groove is formed by the space between the front outer surface 14' of the device and the front guides 31. In normal operation, the upper pins 16 and 16' and lower pins 17 and 17' are in the same parallel groove and move a slight distance apart from the rear engaging teeth 24 of the roller housing. However, when the lower pins 17 and 17' encounter the lower pin engaging guide 19, the lower portion of the inner front surface 14 is forced outwardly and away from the outer front surface 14' in the direction shown by the arrow 32. This motion causes the front teeth 18 to engage the rear roller housing teeth 24, as shown on FIG. 8. The downward movement of the plunger 6 then causes the roller housing and rollers to move downwardly a discreet amount thus forcing toothpaste from the lid of the tube of toothpaste 10. This action forces a discreet amount of toothpaste out of the tube and onto the waiting toothbrush. Since the plunger 6 and plunger brace 7 may only travel a limited amount of distance due to the shape of the plunger aperture 5 and the presence of the plunger stop 33, only discreet amounts of toothpaste will be dispensed. Once pressure on the plunger is released by the operator of the device, the spring 29 then pulls the plunger and inner front mechanism upward in disengaged relationship to the rollers. When another portion of the toothpaste needs to be dispensed, repeating the same action will dispense another discreet amount of toothpaste.

In order to accommodate different sizes of toothpaste the device comes equipped with a number of front toothpaste tube grooves 26 (FIG. 6) and a removable and repositionable toothpaste tube cap bracket 25 (FIG. 5). The front toothpaste tube bracket grooves 26 are best shown on FIG. 6. They comprise a number of front guides 34 which form a series of toothpaste tube bracket grooves 26.

As shown on FIG. 5, the toothpaste tube cap bracket 25 may be interchangeably placed within any of a series of rear toothpaste tube bracket grooves 35. These toothpaste tube bracket grooves 35 form a number of grooves into which the toothpaste tube cap bracket 25 may be placed and correspond to the front toothpaste tube cap bracket guides 34 and grooves 26.

The bottom of the toothpaste tube is secured to the top of the dispenser by means of the toothpaste holder front piece 13. This piece is irregularly shaped and is shown best on FIGS. 4 and 6.

The dispenser may be readily installed to a bathroom wall. The dispenser is lightweight and has no major moving parts so as to be easy to maintain and long-lasting in use. The unique means of engaging the front and rear teeth to drive the rollers a discreet distance is a new and unique method of approaching the problem previously addressed in the prior art. Since a simple spring drives the mechanism, this device is easy to operate and inexpensive to manufacture and maintain.

Having fully described my invention, I claim:

1. A device to supply discreet amounts of toothpaste from a collapsible tube having a flat end and a cap end, comprising:

(1) an outer shell having front and rear halves hingedly attached to each other;

(2) an upper gripping mechanism for attaching the flat end of the tube to the shell, comprising a front gripping protrusion attached to the front half of the shell and a rear gripping mechanism attached to the rear half of the shell, comprising a groove corresponding to said front protrusion and griping teeth in said groove;

(3) a lower adjustable tube cap bracket having an aperture for receiving the cap of said tube;

(4) a rear roller housing comprising a pair of rollers pivotably mounted therein and rear engaging teeth thereon, said rollers adapted to receive said tube; and (5) an inner drive mechanism having a plunger attached thereto which engages said rear roller housing said drive mechanism comprising an inner front surface and inner front sides connected perpendicularly to said front surface, riding on upper and lower pins, biased upwardly by a spring, further comprising front drive engaging teeth corresponding to said rear roller housing engaging teeth, said inner front surface being movable downward by means of said plunger, said pins riding in grooves further comprising lower pin engaging guides which force said front drive engaging teeth into contact with said rear roller housing engaging teeth, when said plunger is pushed downward;

whereby a discreet amount of toothpaste is dispensed each time said plunger is forced downwardly.

* * * * *